US011299898B2

(12) United States Patent
Evans

(10) Patent No.: US 11,299,898 B2
(45) Date of Patent: Apr. 12, 2022

(54) DEVICE FOR SECURING POLES AT THE EDGE OF A VESSEL OR A SWIMMING POOL

(71) Applicant: Ethan Evans, Painesville, OH (US)

(72) Inventor: Ethan Evans, Painesville, OH (US)

( * ) Notice: Subject to any disclaimer, the term of this patent is extended or adjusted under 35 U.S.C. 154(b) by 134 days.

(21) Appl. No.: 16/689,977

(22) Filed: Nov. 20, 2019

(65) Prior Publication Data

US 2020/0157830 A1 May 21, 2020

Related U.S. Application Data

(60) Provisional application No. 62/769,906, filed on Nov. 20, 2018.

(51) Int. Cl.

| | |
|---|---|
| ***E04H 4/16*** | (2006.01) |
| ***E04H 4/14*** | (2006.01) |
| ***A46B 15/00*** | (2006.01) |
| ***A47L 13/48*** | (2006.01) |
| ***A46B 17/08*** | (2006.01) |
| ***B25G 1/00*** | (2006.01) |

(52) U.S. Cl.

CPC ..... *E04H 4/1609* (2013.01); *A46B 15/0097* (2013.01); *A46B 17/08* (2013.01); *A47L 13/48* (2013.01); *B25G 1/00* (2013.01); *E04H 4/14* (2013.01); *Y10T 16/498* (2015.01)

(58) Field of Classification Search

CPC E04H 4/14; E04H 4/16; E04H 4/1609; E04H 4/1618; B63H 16/04; B63H 2016/043; B26G 1/00; B26G 1/01; B63B 59/06; B63B 59/08; B63B 2059/082; Y10T 16/498; A46B 5/00; A46B 15/00; A46B 15/0095; A46B 15/0097; A46B 17/00; A46B 17/08; A47L 13/42; A47L 13/48; A47L 13/50; A47L 13/502; A47L 25/00

USPC ..... 15/1.7, 143.1, 246; 16/436; 114/221 R; 210/470, 471; 248/538, 539, 312.1, 534, 248/535, 682, 687–689; 294/19.3, 17.5, 294/59, 181, 182, 209; 440/101, 110

See application file for complete search history.

(56) References Cited

U.S. PATENT DOCUMENTS

| | | | | |
|---|---|---|---|---|
| 2,063,132 | A * | 12/1936 | Sund | A47L 13/502 15/246 |
| 6,199,821 | B1 * | 3/2001 | Job | A46B 15/0097 248/682 |
| 8,636,260 | B2 * | 1/2014 | Gauger | A46B 17/08 248/687 |
| 2016/0374461 | A1 * | 12/2016 | Lee | A46B 17/08 15/167.1 |
| 2019/0234093 | A1 * | 8/2019 | Galway | E04H 4/1609 |

* cited by examiner

*Primary Examiner* — Mark Spisich
(74) *Attorney, Agent, or Firm* — Jonathan M. D'Silva; MMI Intellectual Property

(57) ABSTRACT

A pole for a swimming pool comprises a tool for swimming pool maintenance located at one end of the pole and a device for preventing the pole from sliding into the swimming pool. The device comprises a face that surrounds the pole generally perpendicular to the pole and a baffle that extends from the outside edge of the face generally parallel to the pole. The device prevents the pole from sliding into the swimming pole by a user placing the baffle on a surface at the edge of the swimming pool.

17 Claims, 4 Drawing Sheets

DEVICE FOR SECURING POLES AT THE EDGE OF A VESSEL OR A SWIMMING POOL

This application claims priority benefit of U.S. Provisional Application No. 62/769,906, filed 20 Nov. 2018.

BACKGROUND

Vessels such as swimming pools, ponds, and material storage tanks have tools that are used to maintain the vessels. These tools are used to clean out the vessels, stir the contents of the vessels, sample the contents of the vessels, remove debris from the vessels, etc. These tools are often attached to one end of poles that allow users to access the inside of the vessel. These poles tend to fall into the vessels and when they do it is inconvenient to retrieve them from inside the vessel. This is a particular inconvenience when users drop their skimmers in swimming pools and the fall into the bottom of the pool. What is presented is a device that is mounted, attached, or formed onto these poles that will secure them to the edge of vessels and swimming pools.

SUMMARY

What is presented is a pole for a swimming pool comprising a tool for swimming pool maintenance located at one end of the pole. A device is mounted to the pole for preventing the pole from sliding into the swimming pool comprising a face that surrounds the pole generally perpendicular to the pole and a baffle that extends from the outside edge of said face generally parallel to the pole. The device prevents the pole from sliding into the swimming pool by a user placing the baffle on a surface at the edge of the swimming pool. Placing the device on a surface at the edge of the swimming pool can cause the pole to be standing upright in a stationary position.

The device may be made available apart from the pole. In some embodiments, the baffle collapses inwardly and forms a non-point contact with the surface on which it is placed. In some embodiments, the device further comprises a lip on the outside edge of the face. The baffle could extend on either side of the face. The device may be movable along the length of the pole or fixed to the pole. The face may be flat or curved or it may have openings. The face may be circular, oval, or polygonal. The baffle could have other configurations such as a continuous surface or a series of teeth.

Those skilled in the art will realize that this invention is capable of embodiments that are different from those shown and that details of the apparatus and methods can be changed in various manners without departing from the scope of this invention. Accordingly, the drawings and descriptions are to be regarded as including such equivalent embodiments as do not depart from the spirit and scope of this invention.

BRIEF DESCRIPTION OF DRAWINGS

For a more complete understanding and appreciation of this invention, and its many advantages, reference will be made to the following detailed description taken in conjunction with the accompanying drawings.

DETAILED DESCRIPTION

Figure 1:
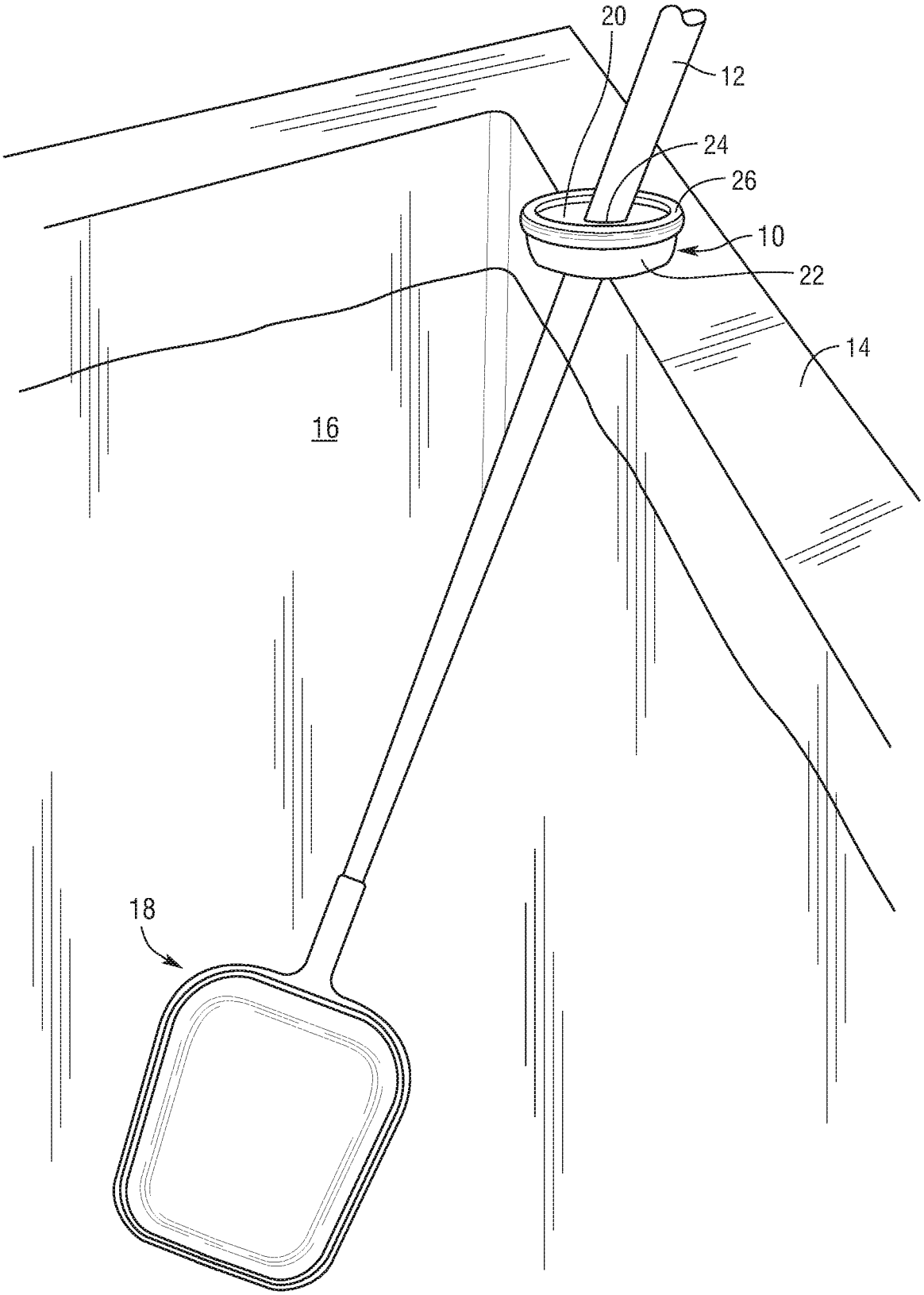
FIG. 1 shows a pole bearing the device secured to the edge of a swimming pool.
Figure 2:
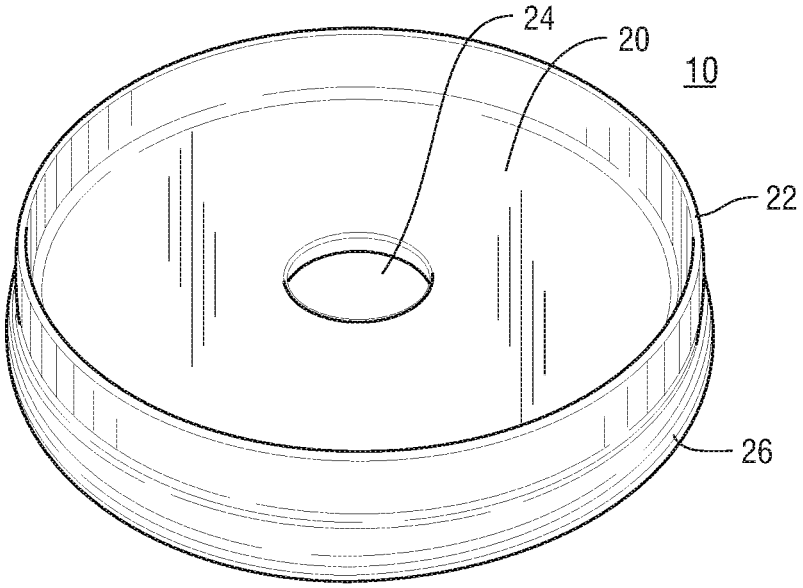
FIG. 2 is a perspective view of the device of FIG. 1 separated from a pole.
Figure 3:
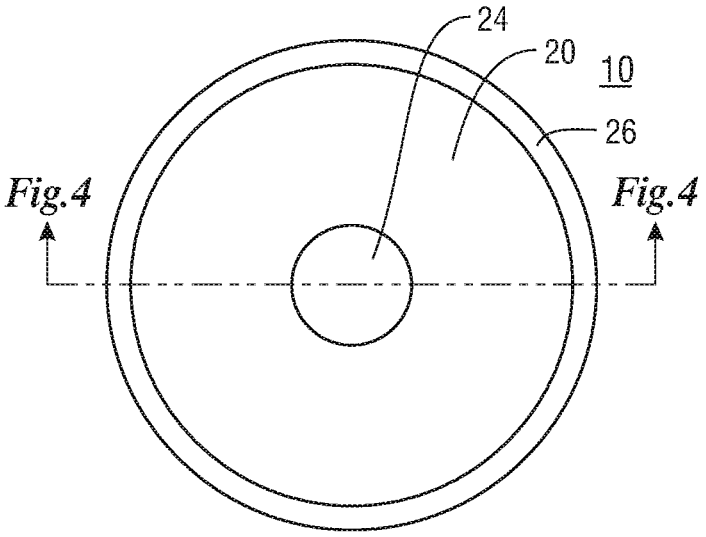
FIG. 3 is a top view of the device of FIG. 1.
Figure 4:
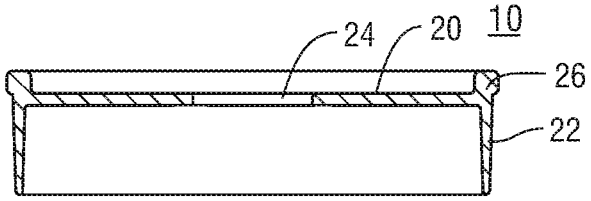
FIG. 4 is a cross-sectional view of the device of FIG. 3.

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

Vessels such as swimming pools and tanks that hold liquid have a variety of tools that are used to maintain the vessels and the contents of the vessels. These tools are typically mounted to poles that can slip into the vessel. What is presented is a solution that allows the pole to be secured at the edge of a vessel such as a swimming pool or a tank. FIG. 1 shows a device 10 mounted to a pole 12 resting on the edge of a vessel 14 filled with a liquid 16, in this case a swimming pool full of water. The pole 12 comprises a tool 18 which in this case is shown to be a skimmer that is commonly used in swimming pool maintenance. The tool 18 is located at one end of the pole 12.

As best understood by comparing FIGS. 1-5 the device 10 prevents the pole 12 from sliding into the vessel 14. The device comprises a face 20 that surrounds the pole 12 generally perpendicular to the pole 12. A baffle 22 extends from the outside edge of the face 20 generally parallel to the pole 12. The device has an opening 24 through which the pole 12 is mounted. The device 10 prevents the pole 12 from sliding into the vessel 14 by a user placing the baffle 22 on a surface at the edge of the vessel 14. This configuration allows the device 10 and the pole 12 to move along the edge of the vessel 14 without the pole 12 falling into the vessel 14.

Figure 5:
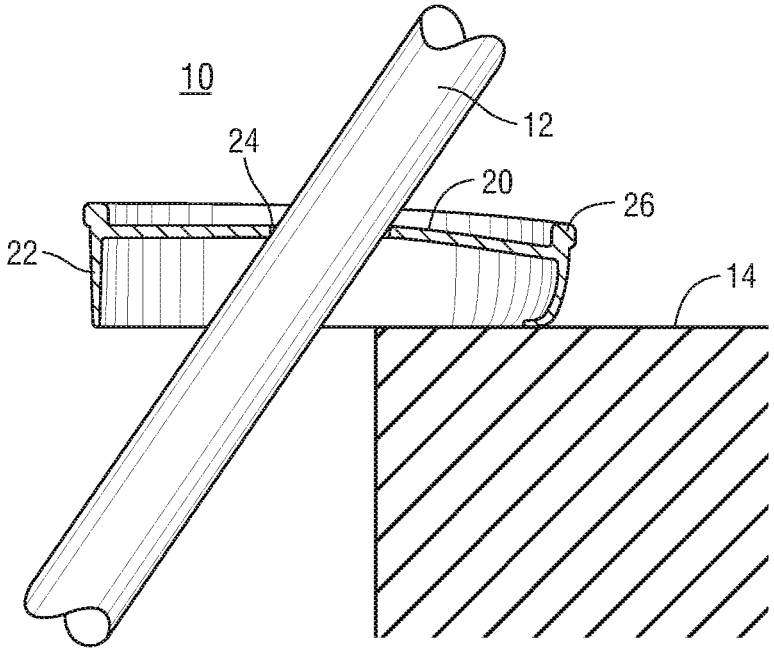
FIG. 5 shows a cross-sectional view of the device of FIG. 1 installed on a pole and resting on the edge of a vessel.

The device 10 is preferably made of an elastomeric material that has a certain amount of pliability to it. As shown in FIG. 5, if the material is soft enough, the baffle 22 collapses inwardly and forms a non-point contact with the surface on which it is placed. This additional non-point contact between the baffle 22 and the vessel 14 helps to maintain the position of the device 10 on the edge of the vessel 14. In this configuration, placing the device 10 on a surface at the edge of the vessel 14 causes the pole 12 to be standing upright in a stationary position on the edge of the vessel 14.

The device 10 could be an attachment that is mounted to the pole 12 and is movable along the length of the pole 12. The device 10 could also be fixed to the pole 12 and unmovable, or it could be formed directly onto the pole 12. The device could further comprise a lip 26 on the outside edge of the face 20. This lip 26 adds stiffness to the device 10. It is preferred that the device 10 be made of a stiff but pliable elastomeric material such as rubber or plastic.

Figure 6A:
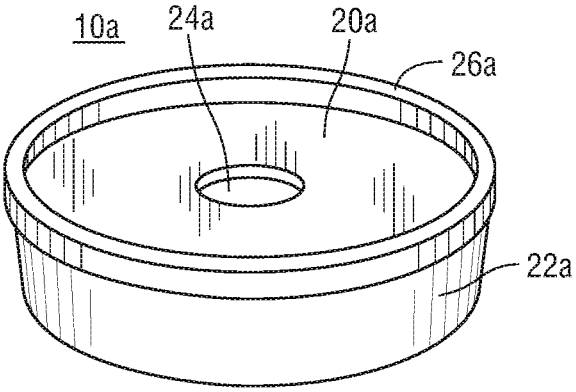
FIG. 6A is a view of another embodiment of the device having a larger face and baffle.
Figure 6B:
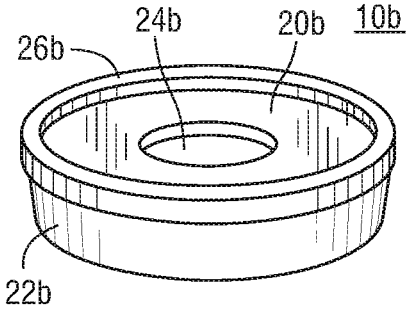
FIG. 6B is a view of another embodiment of the device having a larger opening.
Figure 6C:
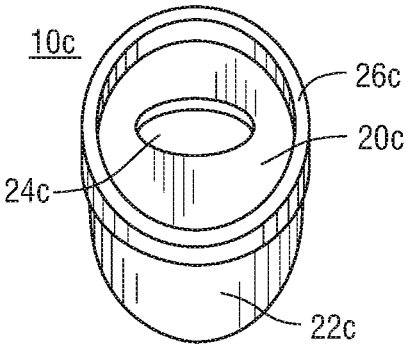
FIG. 6C is a view of another embodiment of the device that has an oval face.
Figure 6D:
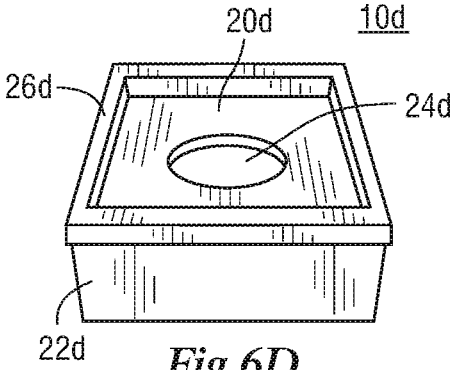
FIG. 6D is a view of another embodiment of the device that has a square face.

The shape and size of the elements of the device could be varied by the application. As shown in FIG. 6A, the face 20*a* of the device 10*a* could be varied as could the size of the baffle 22*a*. FIG. 6B shows that the device 10*b* could have openings 24*b* sized for different diameter poles. FIG. 6C shows that the shape of the device 10*c* could be something other than circular. In this embodiment, the face 22*c* is oval in shape. FIG. 6D shows that the device 10*d* can be a polygon, in this case the embodiment shows a square shaped face 22*d* but other polygonal shapes could be used.

Figure 7:
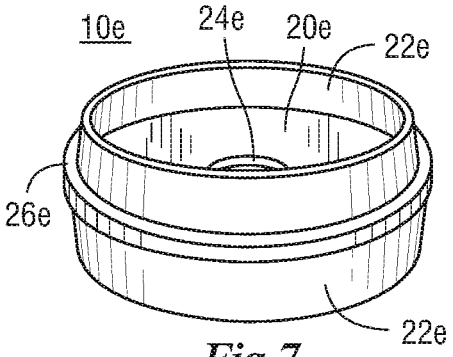
FIG. 7 is a view of another embodiment of the device having a baffle on either side of the face.

FIG. 7 shows another embodiment of device 10*e* in which the baffle 22*e* extends on either side of the face 20*e*. This embodiment allows the device 10*e* to be oriented in either direction on the pole onto which it is mounted. This would also allow the user to secure the pole on the edge of the vessel in either direction such that the tool attached to the pole extends outside the vessel instead of remaining within the vessel. Also, if the pole had tools on either end of the pole, this embodiment allows the pole to be secured with either tool within the vessel.

Figure 8:
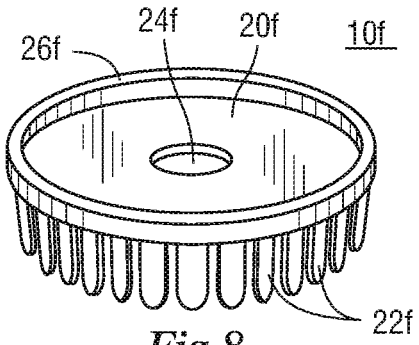
FIG. 8 is a view of another embodiment of the device in which the baffle comprises a series of teeth.
Figure 9:
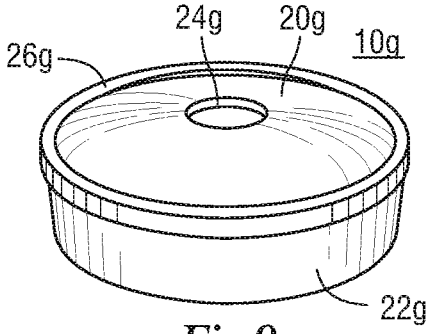
FIG. 9 is a view of another embodiment of the device in which the face is curved.
Figure 10:
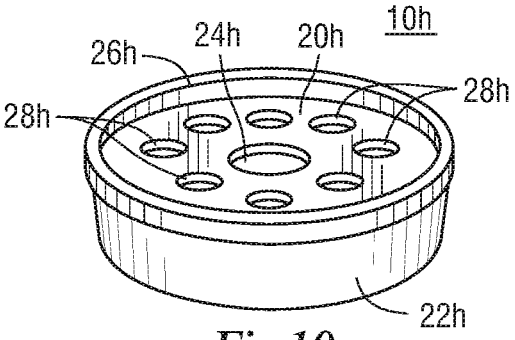
FIG. 10 is a view of another embodiment of the device in which the face comprises a series of openings.

FIG. 8 shows another embodiment of the device 10*f* in which the baffle 22*f* comprises a series of teeth. The face of the device can also be modified in other ways. FIG. 9 shows an embodiment of the device 10*g* in which the face 22*g* is curved. FIG. 10 is a view of another embodiment of the device 10*h* in which the face 20*h* comprises a series of openings 28*h*. The shape, number, and arrangement of these openings 28*h* can be varied.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

What is claimed is:

1. A pole for a swimming pool comprising:

a tool for swimming pool maintenance located at one end of the pole;

a device for preventing the pole from sliding into the swimming pool comprising:

a face that surrounds the pole generally perpendicular to the pole;

a baffle having a height greater than its thickness that extends from the outside edge of said face generally parallel to the pole; and a lip that extends from the outside edge of said face opposite from said baffle having a height that is less than that of the baffle and a thickness greater than that of the baffle;

wherein said device prevents the pole from sliding into the swimming pool by a user placing said baffle on a surface at the edge of the swimming pool such that said baffle collapses inwardly and forms a non-point contact with the surface on which it is placed.

2. The pole of claim 1 in which said device further comprises said baffle extends on either side of said face.

3. The pole of claim 1 in which said device is movable along the length of the pole.

4. The pole of claim 1 in which said device is fixed to the pole.

5. The pole of claim 1 in which said face is flat or curved.

6. The pole of claim 1 in which said face has openings.

7. The pole of claim 1 in which said baffle is a continuous surface or a series of teeth.

8. The pole of claim 1 in which placing said device on a surface at the edge of the swimming pool causes the pole to be standing upright in a stationary position.

9. The pole of claim 1 further comprising said face is circular, oval, or polygonal.

10. A device that is attachable to a pole for preventing a pole from sliding into a vessel, comprising:

an opening configured to receive a pole;

a face that surrounds said opening and generally perpendicular to a pole mounted to said opening;

a baffle having a height greater than its thickness that extends from the outside edge of said face generally parallel to a pole mounted to said opening;

a lip that extends from the outside edge of said face opposite from said baffle having a height that is less than that of the baffle and a thickness greater than that of the baffle;

wherein a pole to which a device is attached is prevented from sliding into a vessel by a user placing said baffle on a surface at the edge of the vessel such that said baffle collapses inwardly and forms a non-point contact with the surface on which it is placed.

11. The device of claim 10 further comprising said baffle extends on either side of said face.

12. The device of claim 10 in which the device is movable along the length of the pole to which it is mounted.

13. The device of claim 10 in which said device is fixed to the pole to which it is mounted.

14. The device of claim 10 in which said face is flat or curved.

15. The device of claim 10 in which said face has openings.

16. The device of claim 10 in which said baffle is a continuous surface or a series of teeth.

17. The device of claim 10 further comprising said face is circular, oval, or polygonal.

* * * * *